US011719522B2

(12) United States Patent
Spork et al.

(10) Patent No.: US 11,719,522 B2
(45) Date of Patent: Aug. 8, 2023

(54) AMMUNITION BODY HOLDING DEVICE WITH EXPANDABLE HOLDING ELEMENT

(71) Applicant: KRAUSS-MAFFEI WEGMANN GMBH & CO. KG, Munich (DE)

(72) Inventors: Roland Spork, Kassel (DE); Matthias Raczek, Kassel (DE); Matthias Czok, Kassel (DE)

(73) Assignee: Krauss-Maffei Wegmann GmbH & Co. KG, Munich (DE)

( * ) Notice: Subject to any disclaimer, the term of this patent is extended or adjusted under 35 U.S.C. 154(b) by 16 days.

(21) Appl. No.: 17/439,931

(22) PCT Filed: Mar. 16, 2020

(86) PCT No.: PCT/DE2020/100199

§ 371 (c)(1),
(2) Date: Sep. 16, 2021

(87) PCT Pub. No.: WO2020/187365

PCT Pub. Date: Sep. 24, 2020

(65) Prior Publication Data

US 2022/0244028 A1 Aug. 4, 2022

(30) Foreign Application Priority Data

Mar. 18, 2019 (DE) ..... 102019106849.5

(51) Int. Cl.
*F42B 39/22* (2006.01)
*F41A 9/09* (2006.01)
*F41A 9/37* (2006.01)

(52) U.S. Cl.
CPC ..... *F42B 39/22* (2013.01); *F41A 9/09* (2013.01); *F41A 9/375* (2013.01)

(58) Field of Classification Search
CPC ..... F42B 39/22; F41A 9/09; F41A 9/375
USPC ..... 89/33.01
See application file for complete search history.

(56) References Cited

U.S. PATENT DOCUMENTS 4,739,691 A * 4/1988 Beutler ..... F42B 39/24 89/1.801
4,898,071 A 2/1990 Borgwarth
5,054,367 A 10/1991 Heldmann et al.
5,223,663 A * 6/1993 Bender-Zanoni ..... F41A 9/09 89/46
5,837,923 A 11/1998 Gay et al.
(Continued)

FOREIGN PATENT DOCUMENTS

DE 3545022 A1 6/1987
DE 3922317 A1 1/1991
(Continued)

OTHER PUBLICATIONS

European Patent Office (ISA/EP), International Search Report (with English translation), International Application No. PCT/DE2020/100199, 6 pages, dated Jun. 17, 2020.
(Continued)

*Primary Examiner* — Bret Hayes
(74) *Attorney, Agent, or Firm* — Thompson Hine LLP

(57) ABSTRACT

An ammunition body holding device that includes a holder for holding the ammunition body, in particular a projectile and/or a propellant, wherein the holder has at least one expandable holding element for holding the ammunition body.

17 Claims, 6 Drawing Sheets

(56) References Cited

U.S. PATENT DOCUMENTS

| | | | | |
|---|---|---|---|---|
| 9,933,217 | B2 * | 4/2018 | Orban | F41A 9/22 |
| 2003/0226771 | A1 | 12/2003 | Corboy et al. | |
| 2005/0241469 | A1 | 11/2005 | Minard et al. | |

FOREIGN PATENT DOCUMENTS

| | | | |
|---|---|---|---|
| DE | 4435985 | A1 | 5/1995 |
| DE | 102011050282 | B3 | 9/2012 |
| DE | 102011050430 | A1 | 11/2012 |

OTHER PUBLICATIONS (PCT) International Bureau of WIPO, International Preliminary Report on Patentability (English translation), International Application No. PCT/DE2020/100199, 9 pages, dated Sep. 30, 2021.

* cited by examiner

AMMUNITION BODY HOLDING DEVICE WITH EXPANDABLE HOLDING ELEMENT

TECHNICAL FIELD

The disclosure relates to ammunition body holding devices having a holder for holding an ammunition body, and more particularly, ammunition body holding devices for holding and/or moving an ammunition body and to a weapons system comprising at least one ammunition body magazine, such as a projectile magazine and/or a propellant magazine, and/or a weapon. In addition, the disclosure describes a method for holding an ammunition body, in particular a projectile and/or a propellant, comprising an ammunition body holding device having a holder.

BACKGROUND

Ammunition body holding devices are known in the art in which the holder is designed in the manner of a grip, for example, which engages around the ammunition body in order to move said body. Particularly with regard to ammunition bodies in the form of propellants, however, holding devices of this kind have not been deployed hitherto, since the forces can only be measured with some difficulty and this could result in dangerous handling of the propellant. To this extent, propellants are usually handled manually. In addition, it is not usually possible for different kinds of ammunition bodies to be handled using one and the same holding device, which makes it necessary for different kinds of holding device to be provided, or for corresponding actions to be performed manually.

To this extent, ammunition body holding devices of this kind have proved disadvantageous, since handling is on the one hand associated with a large degree of effort and, in addition, with a not insubstantial level of risk. In addition, fully automated handling of ammunition bodies of any kind is prevented.

Against this background, the problem to be addressed is that of specifying an ammunition body holding device by means of which the aforementioned disadvantages can be avoided.

SUMMARY

In the case of an ammunition body holding device of the kind referred to above, the problem is solved by the disclosed ammunition holding device in that the holder has at least one expandable holding element for holding an ammunition body.

The disclosed ammunition holding device can be used in a wide range of areas in which ammunition bodies of any kind have to be handled, such as in weapons systems, combat vehicles, magazines, or the like, for example, but also for unloading actions, for example, or for the transportation of ammunition bodies. Hence, in the case of corresponding applications, the ammunition bodies are, for example, stored within the weapons system in a magazine, delivered to the weapon for firing or, however, the ammunition is also filled and/or emptied during deployment. It is necessary in this case for the ammunition bodies always to be handled safely and reliably.

An ammunition body of any kind, in particular a projectile, a mortar, a rocket, and/or a propellant, can be reliably held and/or moved by an expandable holding element. The projectile may be with or without a cartridge. By means of the expanding holding element, the holding force acting on the ammunition body can be suitably regulated according to need. The volume of the holding element can be increased and/or reduced by expansion according to need, so that the holding element is expanded against the ammunition body due to the arrangement on the holder and is thereby held. In this way, ammunition bodies can be handled reliably and safely, in particular independently of their geometric dimensions and/or material properties. When holding an ammunition body, the expandable holding element may adapt to the outer contour of said body, in particular independently of the diameter, surface and/or steps of the ammunition body.

A preferred embodiment envisages that the holder can be adapted to different ammunition bodies which are to be held, in particular projectiles and/or propellants, by means of the holding element. The ammunition body holding device can to this extent be used with a wide variety of applications and/or ammunition bodies, there being no need for different holders to be used which are each adapted to a particular application. The functionality of the ammunition body holding device can thereby be substantially increased. Hence, for example, by means of the holding element being expanded, a smaller diameter and/or a smaller holding force can be set when a propellant is to be handled, for example. In the case of an ammunition body having a larger diameter, such as a projectile, a mortar, a rocket, and/or another propellant, for example, the expansion of the holding element, by contrast, can lead to a larger radius and/or a greater holding force being set and larger and/or heavier ammunition bodies also being safely handled as a result.

It is particularly preferable for the holding element to be expandable through the pressure of a fluid. In particular, the fluid can be introduced into the inside of the holding element. It has proved particularly advantageous in this case for a gas, in particular compressed air, and/or a fluid, in particular hydraulic fluid, to be used as the fluid. The required pressure in the inside of the holding element can be produced through the introduction of a predefined quantity of fluid into said holding element and the holding element can be expanded and/or contracted to an advantageous size. The holding element may have a cavity in the inside, into which the fluid can be introduced. The holding element can therefore be inflated by the fluid and can thereby expand.

The pressure can advantageously be produced pneumatically and/or hydraulically.

In a particular embodiment, the pressure can be produced by means of a pressure generator, such as a pump, a compressor, a manual handle, or the like. The holding element and/or the holder may preferably have a pneumatic and/or hydraulic connection for this purpose which can be attached to a line system. Through the introduction and removal of fluid, the pressure in the holding element can be controlled. The pneumatic and/or hydraulic connection may, in addition, have a valve, by means of which the incoming flow of fluid can be controlled. The valve may preferably be of manual, electrical and/or magnetic design. It is particularly preferable for the valve to be actuated only starting from a predefined response pressure and/or to act only in one direction. With a plurality of valves, each valve can, in addition, be controlled individually and/or multiple valves can be controlled jointly. When there is a multiplicity of connections, each connection in this case can be controlled individually or, however, the connections can also be controlled in their totality.

In accordance with a particular embodiment, it is provided that the holding force can be set through an adjusted application of pressure by the holding element. By means of high pressure in the inside of the holding element, a high holding force can preferably be produced, and by means of a lower pressure in the inside of the holding element, a lower holding force can be produced. In this way, ammunition bodies with a relatively heavy but stable design can be held using a high holding force, and ammunition bodies with a sensitive, less stable design, such as propellants, can be held with a lower holding force. The application of pressure by the holding element in this case can particularly preferably take place depending on the shape, mass, fragility, and the like, of the ammunition body in this case. A control device for controlling pressure is advantageously provided. In this way, an adjustment can be made to a wide variety of ammunition body types, as a result of which greater usability can be achieved. In addition, through increasing pressure in the expandable holding element, said holding element can be expanded, and with decreasing pressure there is a corresponding contraction. It follows from this that a propellant module located in the module holder can be held when there is increasing pressure in the expandable holding element and can be released when the pressure in the expandable holding element reduces.

In an embodiment, the pressure in the expandable holding element is measured. Different measuring devices such as pressure sensors or barometers, for example, can be provided for this purpose. The measuring devices may be arranged on the holder and/or in the holding element. By means of the pressure measurements in the holding element, continuous or, where necessary, different tests can be carried out, such as leakage tests, for example. The functional capability of the holding element can preferably be examined in this way. Moreover, it is conceivable that by measuring the pressure in the expandable holding element, it is possible to check whether an ammunition body is held by the holder or whether no ammunition body is held.

In addition, it is advantageous for the holding element to be expandable in the radial direction, in particular in the direction of the ammunition body axis. In this way, a holding force acting in the radial direction, in particular in the direction of the ammunition body axis, results, which means that the ammunition body can preferably be clamped in the holder centrally.

In addition, it is advantageous for the ammunition body to be clampable in the holder by means of the holding element. In this way, the ammunition body can be held safely and reliably and thereby moved into the weapon, for example, or held in a magazine. In particular, the expansion of the holding element means that the pressure, and therefore the volume of the holding element, can be increased and a clamping force can thereby be produced between the holder and/or holding element and the ammunition body on account of the rigid holder. Due to the expansion of the expandable holding element against the ammunition body, the clamping and counter-clamping can result, wherein as the pressure in the expandable holding element increases, the clamping and counter-clamping increase too. To this extent, a higher holding force, in particular a higher maximum holding force, can be produced as a result of this as the pressure in the expandable holding element increases.

A structural embodiment envisages that the holder has at least two holding elements, in particular three holding elements, in a radial direction, in particular along the circumference thereof. Through the provision of multiple holding elements, the ammunition body can be fixed at multiple contact points. In this way, clamping and counter-clamping can be achieved via the holding elements. By means of a third holding element, this clamping can be additionally improved. In particular, the ammunition body can be fixed in the holder in the manner of a three-point bearing. The holding elements can in this way engage around the ammunition body. It can further be provided that at least one of the expandable holding elements raises the ammunition body from the holder when the expandable holding element expands. In this case, the arrangement of the expanding holding elements on the holder can be configured in such a manner that the ammunition body is only in contact with the holding elements. Alternatively, or in addition, further holding elements can also be provided along the circumference of the holder, in particular in order to further increase the holding force.

From a structural viewpoint, it is proposed that the holding element has at least one holding face facing the ammunition body. The ammunition body can come into contact with the holding element on the holding face. The surface of the holding face can preferably be configured in such a manner that the clamping effect is increased, for example through a surface coating or surface structuring. Coatings made of rubber, plastic or another material, for example, can be used as the surface coating and/or coatings from which a high frictional coefficient between the holding element and the ammunition body results.

The holder may be configured as a gripping device. In particular, the holder may be designed in the manner of pincers, a yoke, or the like. The holder may have a semicircular shape, so that a receiving means is formed in which the ammunition body can be introduced. The holder can preferably engage around the ammunition body, at least in part. The holder may be designed as a rigid element and/or as a movable element, according to need. A movable embodiment offers the advantage that the gripping device can initially be reduced in size by a given order of magnitude and the remaining distance can then be covered by means of the expandable holding elements. In this way, the flexibility of the ammunition body holding device can be further enhanced.

In certain embodiments, the holding elements are arranged at the holder ends, in particular the gripper ends, and/or in the center of the holder. In this way, a reliable mounting of the ammunition body, in particular in the manner of a two-point or three-point bearing, can be produced.

In structural terms, it is further proposed that the at least one holding element should be designed as an expandable cushion. The holding elements in this case may, in particular, be designed as rubber and/or fabric mats or as hoses in this case. The holding elements may, in addition, be of any shape. However, it has proved particularly advantageous for cuboid-shaped cushions to be used. Particularly preferably, the material can be selected in such a manner that it also withstands high loads, in particular pressures. Fiber-reinforced, textile and/or polymer materials have proved particularly advantageous materials. The cushion may have an expandable elastic casing, such as a membrane. The expansion can thereby be supported and the cushion can adapt to the shape of the ammunition body being held.

In an exemplary embodiment the holding elements are controlled for expansion individually and/or jointly. In particular, the holding elements can be exposed to different pressures and therefore expanded accordingly to different degrees and/or expanded at different points in time. In this way, the adjustment of the ammunition body holding device to the ammunition body being handled and held, in particular to the shape, diameter, or the like, can be further improved.

In accordance with a structural embodiment, it is further proposed that the holder should be designed as a longitudinal ammunition body receiving means. Alternatively, or in addition, the ammunition body holding device may also comprise multiple holders which can be combined to form an ammunition body receiving means. The individual holders in this case can be connected to one another by means of an adhesive, welded or clamping connection, for example. It is preferable for multiple holding elements to be provided in a plane parallel to the ammunition body center axis, in particular in the manner of a row, and/or along the circumference of the holder. In this way, the ammunition body can be held at multiple contact points along its length and/or its circumference. In this way, a plurality of different ammunition bodies can be reliably handled in a simple fashion.

Irrespective of the category of weapon, the caliber of the ammunition bodies may, in particular, be at least 50 mm, preferably at least 100 mm, and particularly preferably at least 150 mm. Particularly preferably, the ammunition body holding device can be deployed for large-caliber ammunition bodies and for use in large-caliber guns.

In the case of a handling device of the kind referred to above, the problem is solved by an ammunition body holding device of the kind described above. The same advantages as those already described in connection with the ammunition body holding device result. All features in this case can be applied either alone or in combination.

It is particularly preferable for the ammunition body holding device to be part of a handling device which can be used for filling and emptying ammunition, positioning, and the like, but also for several of these actions. The handling device may be designed as a hinged cantilever and/or as a tipping device, for example. The handling device may preferably be part of a weapons system and/or an ammunition body magazine. Particularly preferably, the handling device and/or the ammunition body holding device may be arranged between the weapon and one or multiple ammunition body magazines.

In an exemplary embodiment, the handling device has a guiding device to which the ammunition body holding device can be fastened. In order to receive and/or position an ammunition body, the ammunition body holding device can preferably be pivoted about a pivoting axis of the guiding device and thereby moved from a horizontal position into a vertical position, for example, and vice versa. Intermediate positions are also conceivable. In addition, the ammunition body holding device can be mounted for displacement along the guiding device, so that distances between a position behind the barrel and an ammunition body magazine can thereby be bridged, for example. Alternatively, or in addition, the handling device can preferably also be movably arranged within the weapons system.

The problem is furthermore solved in the case of a weapons system of the kind referred to above by an ammunition body holding device or a handling device of the kind described above. Here, too, the same advantages as those already described above result, wherein all features can be applied alone or in combination.

In another embodiment of the weapons system, in order to load an ammunition body, in particular both of a propellant and a projectile, the handling device and, in particular, the ammunition body holding device is arranged both in the ammunition flow between the propellant magazine and the weapon, and also in the ammunition flow between the projectile magazine and the weapon. It is not therefore necessary for multiple handling devices and/or ammunition body holding devices to be provided, each of which handles different kinds of ammunition bodies separately. In this way, the weapons system can have a fully automatic design. In addition, it is advantageous for the handling device and/or the ammunition body holding device to be further arranged in the ammunition flow between one or multiple external ammunition body magazines and the weapon. In this way, ammunition bodies from external ammunition body magazines can also be used.

In addition, it is advantageous for the handling device and/or the ammunition body holding device to be capable of being used for filling and/or emptying ammunition and/or for securing the position of an ammunition body. It is not necessary for separate handling devices and/or ammunition body holding devices to be used for filling or emptying ammunition or for these activities to be carried out manually. In this way, safety can be further improved. Particularly preferably, ammunition body holding devices can be provided in the inside of the ammunition body magazine, by means of which at least one ammunition body, but preferably multiple ammunition bodies, can be held simultaneously. In particular, multiple ammunition body holding devices can preferably be provided above one another for holding the ammunition body. The ammunition body holding device may be arranged as the delimitation between the individual rows of ammunition bodies in the ammunition body magazine and hold the ammunition body from the side.

With a method of the kind referred to above, the problem is solved in that the holder has at least one expandable holding element for holding an ammunition body which is expanded for holding.

Here, too, the same advantages results as have already been described in connection with the ammunition body holding device and/or the holding device and/or the weapons system. Here, too, all features can be applied alone or in combination.

In another embodiment of the method, the holding element is contracted in order to release the ammunition body. In this way, the ammunition body can be released again, for example in the manner of a completed handling, and moved by a further ammunition body holding device, for example. By means of a holding of the ammunition body when the holding element is expanded and a release by means of the contraction of the holding element, the ammunition body can be transported over any distances and/or held fast and stored in a given position. In this way, an ammunition body can be passed on to a magazine and/or a weapon, for example, and/or removed from a magazine and/or stored in a magazine.

The introduction of a fluid into the holding element preferably produces pressure in the inside of said holding element, as a result of which the holding element can be expanded and/or contracted.

The features described with the help of the method, the handling device, or the weapons system can also be used alone or in combination in the case of the ammunition body holding device described above too.

BRIEF DESCRIPTION OF THE DRAWINGS

Further details of the disclosed system and method are to be described in greater detail below with the help of the exemplary embodiments depicted in the figures. In the drawing.

DETAILED DESCRIPTION

Figure 1:
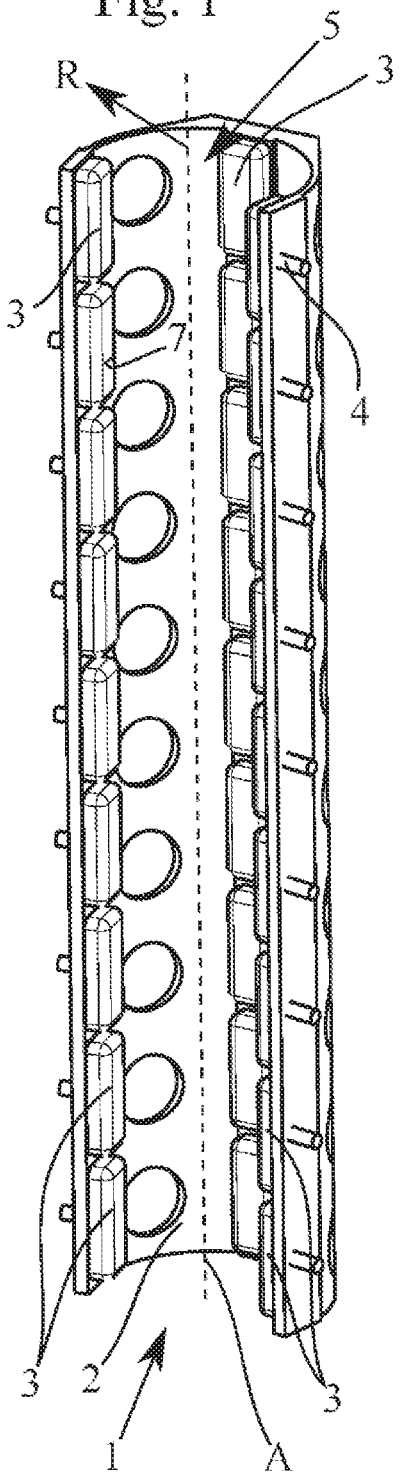
FIG. 1 shows a perspective view of a first exemplary embodiment of the disclosed ammunition body holding device.
Figure 2:
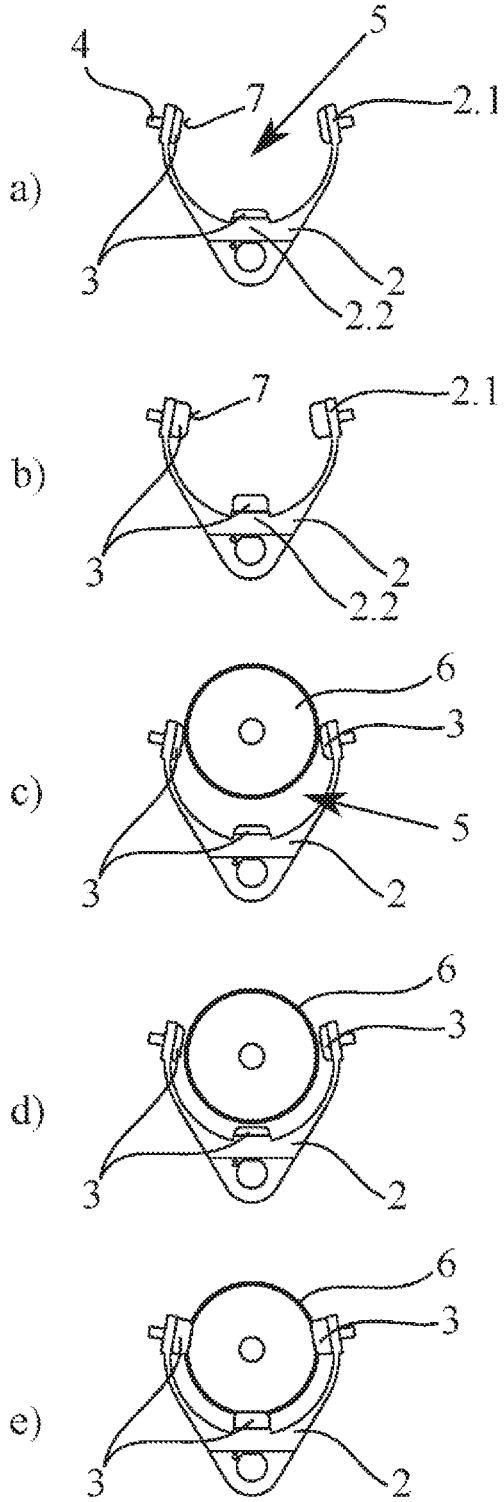
FIGS. 2(*a*)-(*e*) show a sectional depiction of an ammunition body holding device of FIG. 1 in different stages of receiving an ammunition body.

FIG. 1 shows an ammunition body holding device 1, by means of which a wide variety of different kinds of ammunition bodies 6 and, in particular, projectiles 6.1 and/or propellants 6.2 can be handled safely and reliably. Corresponding ammunition bodies 6 can be used in weapons systems 14, for example, as in artillery guns, combat vehicles, or the like, for example, particularly in the area of magazines 9, 10, 12, 13 or for filling and/or emptying ammunition.

In corresponding weapons systems 14, a wide variety of different kinds of ammunition bodies 6 are generally used in this case, and these are typically handled using different ammunition body holding devices 1 assigned to a type of ammunition body in each case, or manually. The ammunition bodies 6 frequently differ in terms of geometry, material, mass, or the like. Ammunition bodies 6 also differ in terms of sensitivity. Consequently, projectiles 6.1 are usually substantially more robust in design than propellants 6.2, for example. However, the projectiles 6.1 are then usually also substantially heavier and have a greater circumference, for example, than is the case with propellants 6.2, for example.

So that ammunition bodies 6 of the most varied kinds can be handled safely and reliably, and in order to be able to facilitate fully or partially automated handling too, a holder 2 which has at least one expandable holding element 3 for holding the ammunition body 6 is provided in the case of the ammunition body holding device 1 according to the invention.

In an embodiment, an ammunition body holding device 1 is therefore provided which can be used for different kinds of ammunition bodies 6 and, to this extent, can be used in a plurality of weapons systems 14 with automated ammunition feed.

The ammunition body holding device 1, as can be seen in particular in the detail in FIGS. 1 and 2*a* to 2*e*, has a holder 2 which is designed for holding the ammunition body 6 and, in particular, a projectile 6.1 and/or a propellant 6.2. At least one expandable holding element 3 is arranged on the holder 2, which holding element can be expanded to hold the ammunition body 6. With the help of the holding element 3, the holder 2 and, in particular, the ammunition body holding device 1 can be adapted to a wide variety of different kinds of ammunition bodies 6, in terms of diameter, geometry, form, mass, or the like, for example.

As can furthermore be seen in FIG. 1 or 2*a* to *e*, the holder 2 in accordance with the present exemplary embodiment is designed as a kind of gripping device which has a pincer-shaped geometry overall. The holder 2 is designed in such a manner that it engages around the ammunition body 6 at least in part. The ammunition body 6 can be introduced into the receiving means 5 formed in this way and then held by the expanded holding element 3.

The holder 2 has at least one holding element 3. It has proved advantageous, however, for at least two, in particular three, holding elements 3, to be arranged along the circumference of the holder 2, i.e. in a radial direction R. The holding elements 3 are arranged spaced apart from one another, so that a three-point bearing of the ammunition body 6 that has been introduced results. Alternatively, however, only one expandable holding element 3 may also be provided, for example, which is arranged at only one point or also along the entire circumference of the holder 2. As is further shown by the depictions in FIG. 2, the holding elements 3 are arranged at the holder ends 2.1 and also in the center of the holder 2.2. However, the invention is not limited to this. Instead, embodiments are also conceivable in which only one holding element 3 or a different number of holding elements 3 is provided.

The ammunition body 6 is held by a holding face 7 of the holding element 3. The holding face 7 faces the ammunition body 6 and can come into contact with the ammunition body 6. The surface of the holding face 7 can preferably be configured in such a manner that a clamping effect produced by the expansion of the holding element 3 is increased, for example by a surface coating or surface structuring. Coatings made of rubber, plastic or another material can be used as the surface coating and/or coatings which give rise to a high frictional coefficient between the holding element 3 and the ammunition body 6.

In order to hold the ammunition body 6, the holding elements 3 can, in particular, be expanded by the pressure of a fluid 21. The pressure in the holding element 3 can preferably be produced hydraulically and/or pneumatically in this case. Through the application of pressure to the holding element 3, said holding element 3 is expanded and thereby produces a holding force which holds the ammunition body 6 through contact with the ammunition body 6. The holding elements 3 act particularly in a radial direction R, i.e. they produce a radial force in the direction of the ammunition body axis A.

The pressure can in turn be generated by means of a pressure generator 18 not depicted in greater detail, for example, such as a pump or a compressor, for example. For this purpose, at least one connection 4 for connecting a hydraulic and/or pneumatic line system is provided on the holding element 3. In this way, the fluid 21 can be introduced and removed, as a result of which the pressure in the inside of the holding element 3 can be controlled. Hence, for example, a high holding force can be produced by means of a high pressure and a low holding force by means of a lower pressure. The holding force can be set by means of an adjusted pressure application by the holding element 3. In this way, different ammunition bodies 6 can be kept operationally safe and free from damage.

The individual connections 4 of the holding elements 3 can preferably be controlled individually, as a result of which said holding elements 3 can be controlled jointly and/or separately. So that the pressures in the holding elements 3 can be checked in addition, sensors which are not depicted in greater detail can be provided which measure the internal pressure of the holding elements 3. In this way, there can be a feedback and the holding pressure can be controlled according to need or, however, a fault can also be identified.

According to the present exemplary embodiment, the holding element 3 is configured as a cushion, in particular as a high-pressure cushion, which has a cuboid shape overall. Alternatively, however, embodiments with a round, oval, tubular, or other, cushions are also possible. The holding element 3 may, in addition, be produced from a plastic material and have a membrane, for example. In this way, when holding an ammunition body 6 the holding element 3 can be adapted to the outer contour of said ammunition body 6.

A first embodiment of the ammunition body holding device 1 according to the invention is shown in FIG. 1. As can be seen, the ammunition body holding device 1 is designed in the manner of an elongate ammunition body receiving means 5 which has a plurality of holding elements 3. The holding elements 3 in this case are firstly arranged on the holder 2 in a longitudinal direction, in particular in a direction parallel to the ammunition body holding device axis or ammunition body axis A, in rows behind one another. In addition, multiple holding elements 3 are also provided in the radial direction R, in particular along the circumference of the holder 2. By means of an embodiment of this kind, a wide variety of different kinds of ammunition bodies 6 can easily be handled, as is shown by way of example in FIG. 3. Depending on the ammunition body 6, the holding elements 3 can apply the same pressure or a different pressure at the same time and/or at different times. Consequently, the ammunition body holding device 1 can be adjusted to any ammunition bodies 6.

Alternatively, or in addition, the ammunition body holding device 1 may also be designed as a holder 2 which only has only one holding element 3 in the longitudinal direction, or one or multiple holding elements 3 along the circumference, for example. The ammunition body holding device 1 may also have a rather short length, corresponding to the length of a holding element 3, for example.

Figure 9:
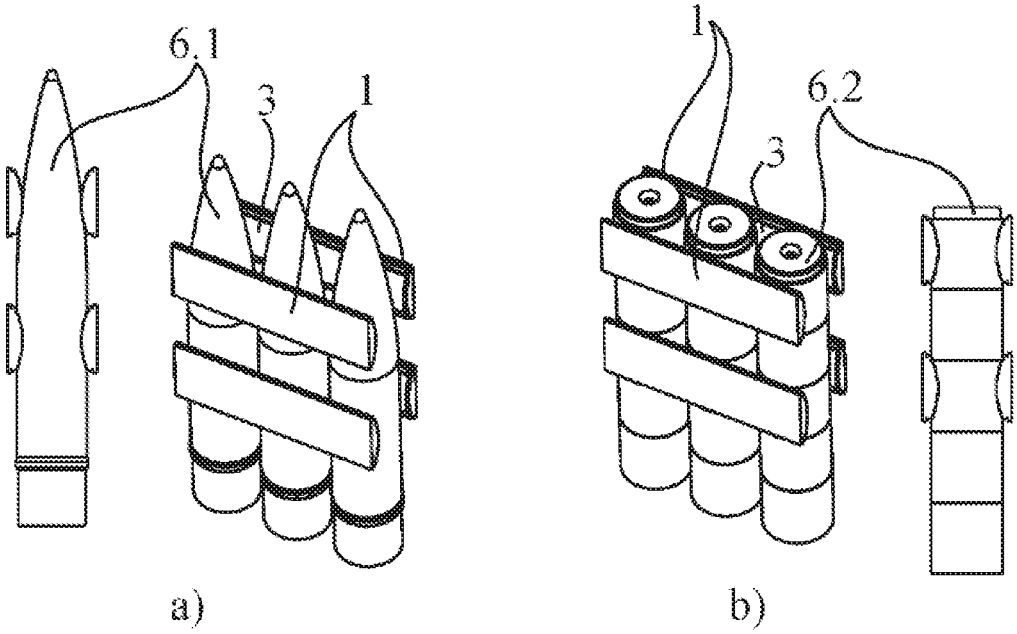
FIG. 9 shows details from the projectile magazine and propellant magazine with a second exemplary embodiment of the disclosed ammunition body holding device.

A further exemplary embodiment of an ammunition body holding device 1 according to the invention is shown in FIG. 9, for example, and this can be used in any weapons system 14 and, in particular, in each ammunition body magazine 9, 10, 12, 13, alternatively or additionally.

In that case, the ammunition body holding device 1 is designed as an elongate ammunition body holding device 1 which has only one holding element 3. The ammunition body holding device 1 is arranged in one, or multiple, of the ammunition body magazines 9, 10, 12, 13 and is used for holding the ammunition body 6 in the magazines 9, 10, 12, 13. In particular, multiple ammunition body holding devices 1 of this kind can be provided which work together. Hence, for example, ammunition body holding devices 1 which each expand in relation to one another and thereby clamp the ammunition bodies 6 between them can be provided between each individual row of ammunition bodies 6. In addition, multiple ammunition body holding devices 1 can be provided at different heights, so that the ammunition bodies 6 are held at the top and bottom, for example. In this way, safe transportation can be guaranteed, even during movement, for example a journey made by a combat vehicle.

With the help of an ammunition body holding device 1 according to the invention, differences between the different shapes and kinds of ammunition bodies 6 can be compensated for. With the help of the expandable holding element 3 which is positioned on a holder 2, the different geometric ammunition bodies 6 can be securely held. The holding elements 3 in this case are arranged behind one another and at right angles to the holder axis A. These can be filled, as required, independently of one another, namely such that on the one hand heavy projectiles 6.1 remain positioned and, on the other hand, the light, filigree propellants 6.2 are not damaged.

The receiving means and the holding action are to be explained in greater detail with the help of the depictions in FIGS. 2*a* to *e*.

In FIG. 2*a* the holding elements 3 are initially contracted and not expanded. The pressure in the inside of the holding elements 3 tends to be low. In this position, the ammunition body holding device 1 is prepared for receiving an ammunition body 6.

FIG. 2*b* shows by way of example expanded holding elements 3, wherein no ammunition body 6 is received, however. The pressure in the inside of the holding elements 3 has become greater, since the cushions, as holding elements 3*a*, have been pumped up with a fluid 21, in particular compressed air.

In order to hold an ammunition body 6, said ammunition body 6 can initially be pushed, inserted, or the like, into the ammunition body holding device 1 and, in particular, received by the ammunition body receiving means 5. This process is shown in FIG. 2*c*. According to need and the ammunition bodies 6 used, the holding elements 3 can then be controlled and expanded, in particular by means of a control device. Prior to expansion, the ammunition body 6 lies loosely in the ammunition body receiving means 5, cf. FIG. 2*d*.

Through expansion of the holding element 3, the ammunition body 6 is then finally held and clamped between the holding elements 3 in the holder 2, cf. FIG. 2*e*. In this way, the ammunition body 6 can be held reliably and safely and thereby moved into the weapon 8, for example, or held in a magazine 9, 10, 12, 13. Through expansion of the holding element 3, the pressure, and therefore the volume, of the holding element 3 can be increased and a clamping force can thereby be produced between the holder 2 and/or holding element 3 and the ammunition body 6 due to the rigid holder 2. Expansion of the expandable holding element 3 against the ammunition body 6 can result in clamping and counter-clamping, wherein as pressure increases in the expandable holding element 3, the clamping and counter-clamping also increase. To this extent and as a result of this, a greater holding force, in particular a greater maximum holding force, can also be produced as pressure increases in the expandable holding element 3.

Figure 3:
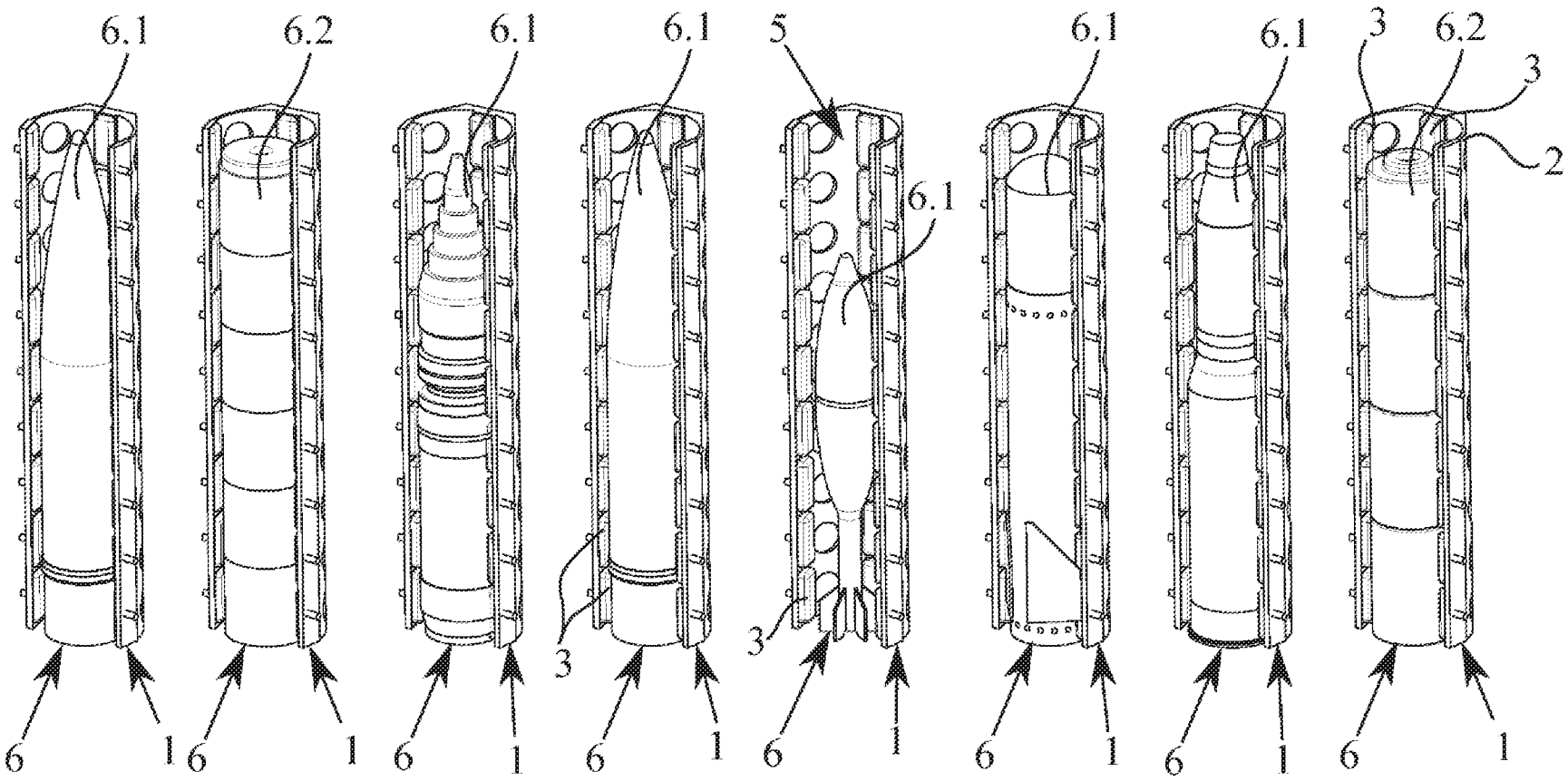
FIG. 3 shows perspective views of the ammunition body holding device of FIG. 1 with different ammunition bodies.

By means of the ammunition body holding device 1 according to the invention, through the use of expandable holding elements 3, in particular high-pressure cushions, different ammunition bodies 6 with different masses and shapes can be handled using a standard method or holding mechanism, see also the different exemplary depictions in FIG. 3. The ammunition body holding device 1 can be used for holding, conveying and/or storing ammunition bodies 6, in particular projectiles 6.1 and/or propellants 6.2.

Figure 4:
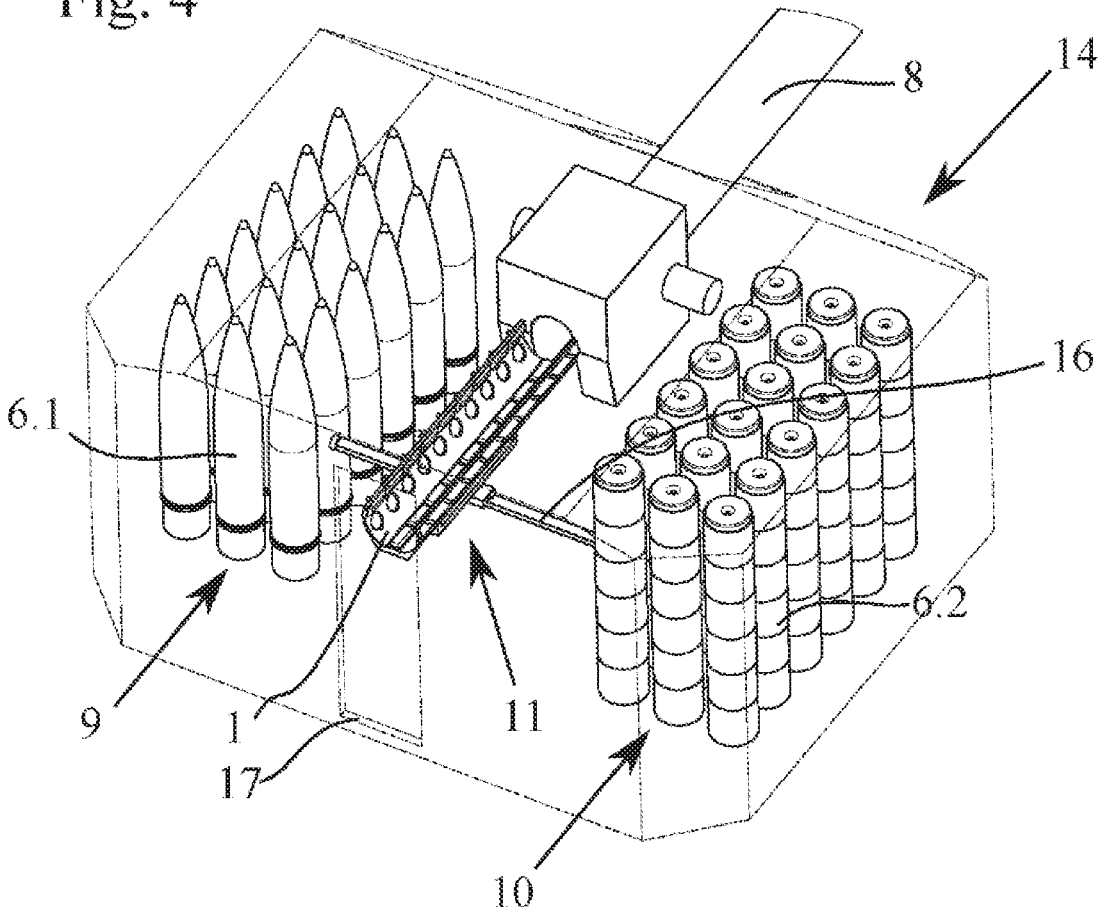
FIG. 4 shows a perspective view of a weapons system having a handling device with the disclosed ammunition body holding device of FIG. 1.
Figure 5:
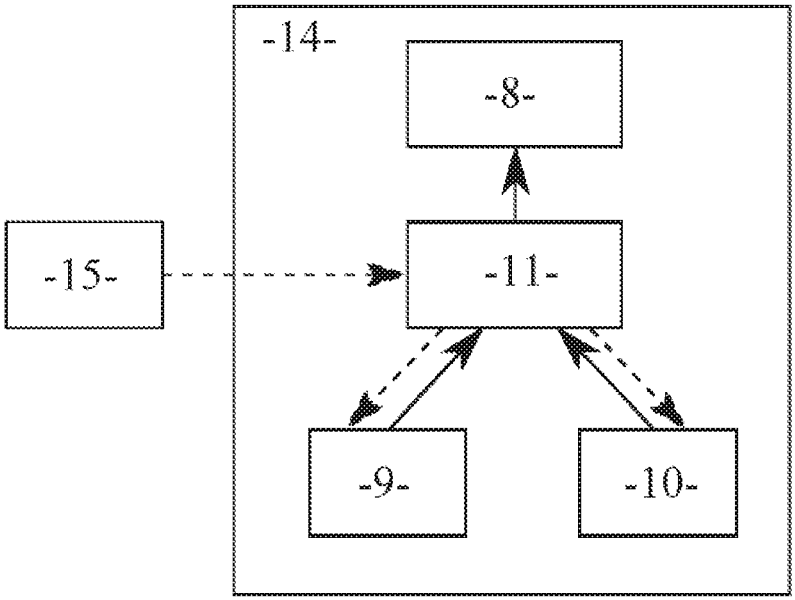
FIG. 5 shows a schematic representation of a weapons system incorporating the disclosed ammunition body holding device.

FIG. 4 shows the use of an ammunition body holding device 1 in a weapons system 14, in particular a combat vehicle or an artillery gun, which comprises a weapon 8, in particular a barrel weapon, a projectile magazine 9 with multiple projectiles 6.1, and a propellant magazine 10 with multiple propellants 6.2. Here, the ammunition body holding device 1 is part of an ammunition body handling device 11. The ammunition body handling device 11 is arranged both in the ammunition flow between the propellant magazine 10 and the weapon 8, and in the ammunition flow between the projectile magazine 9 and the weapon 8. In this case, it is then no longer necessary for different handling devices 11 to be provided for different ammunition bodies 6, in particular projectiles 6.1 and propellants 6.2. Through adjustment by means of the expanding holding element 3, universal deployment of the ammunition body holding device 1 can take place. The ammunition body handling device 11 in this case is used as a loading device for supplying projectiles 6.1 and propellants 6.2 to the weapon 8. For this purpose, the ammunition body holding device 1 may, for example, be arranged on a guiding device 16, along which the ammunition body holding device 1 can be moved between a receiving position, in which the ammunition body holding device 1 can remove the ammunition body 6 from one of the magazines 9, 10, in particular, and a loading position behind the weapon 8. In order to receive the ammunition body 6, the ammunition body holding device 1 can, in particular, be pivoted about a pivot axis and, for example, from a horizontal position into a vertical position.

Alternatively, or in addition, a corresponding ammunition body holding device 1 can also be used for filling and/or emptying ammunition. For this purpose, the ammunition body holding device 1 can be moved into the region of a hatch 17 of the weapons system 14, for example. Ammunition bodies 6 can be introduced into the weapons system 14 from outside, for example by means of an ammunition filling and emptying device, as is described in DE 10 2011 050 430 A1, for example, or further conveyed manually and then by means of the ammunition body holding device 1.

Figure 7:
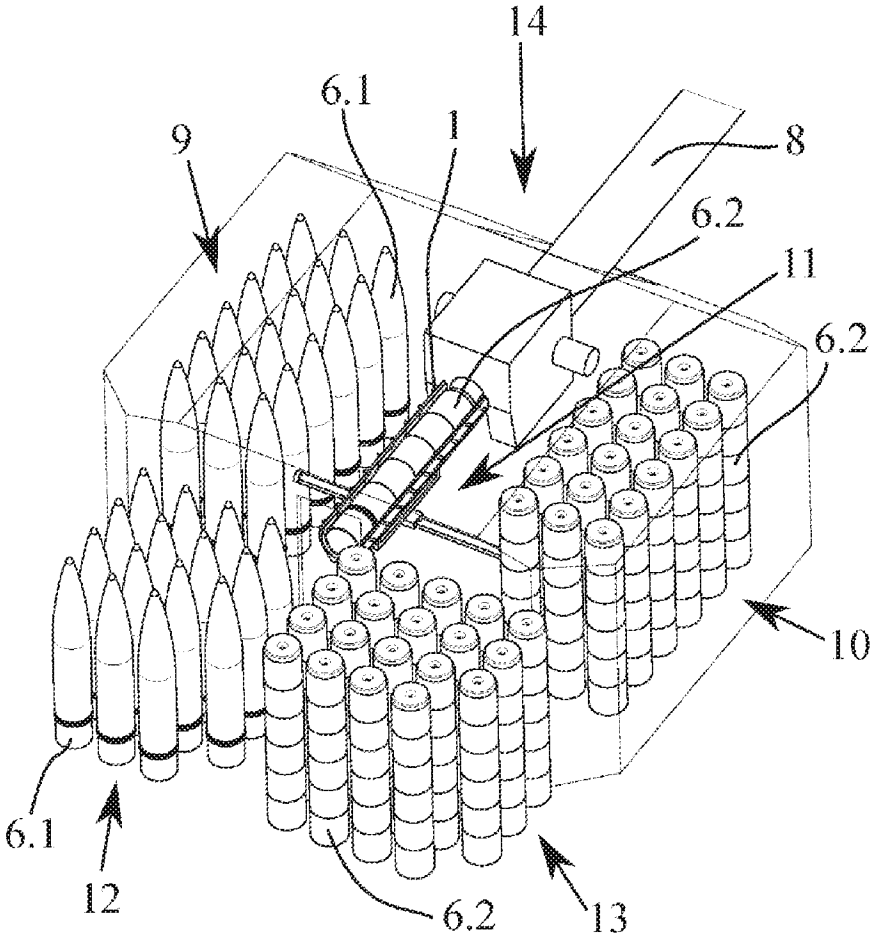
FIG. 7 shows a schematic representation of a weapons system with external ammunition body magazines arranged thereon and an embodiment of the disclosed ammunition body holding device in a loading position.
Figure 6:
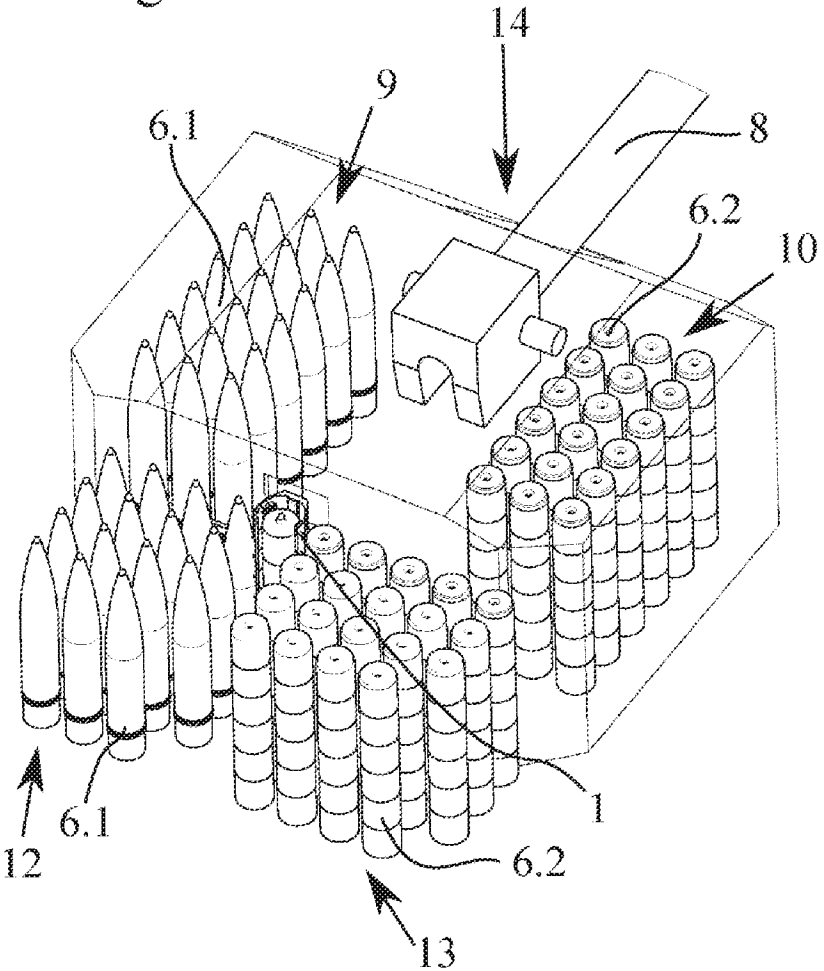
FIG. 6 shows a schematic representation of a weapons system with external ammunition body magazines arranged thereon and the ammunition body holding device of FIG. 1 in a receiving position.
Figure 8:
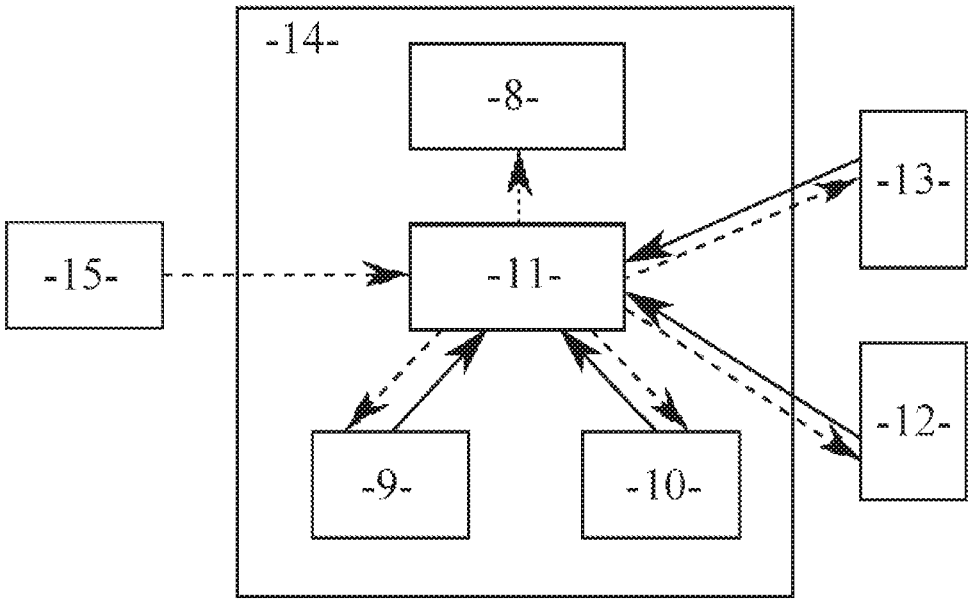
FIG. 8 shows a schematic representation of a weapons system with external ammunition body magazines.

An alternative or additional embodiment of a weapons system 14 is shown in FIGS. 6 to 8. As can be seen, the weapons system 14 is designed to be substantially identical to the exemplary embodiment shown in FIG. 4. However, in this case further ammunition body magazines 12, 13 are provided in addition, which are configured as external ammunition body magazines 12, 13. These can be fastened to the outside of the weapons system 14 subsequently, for example, and store additional ammunition bodies 6. In the present case, an additional external projectile magazine 12 and also an additional propellant magazine 13 can be provided. However, arbitrary embodiments of the weapons system 14 with a different number of internal and/or external magazines 9, 10, 12, 13 are conceivable.

As can be further identified, both ammunition bodies 6 from the internal magazines 9, 10, and ammunition bodies 6 from the external magazines 12, 13 can be handled by means of the handling device 11 and, in particular, the ammunition body holding device 1. Hence, FIG. 6 shows by way of example a position of the ammunition body holding device 1 in which propellants 6.2 can be removed from the external ammunition body magazine 13 and then, as is shown in FIG. 7, moved into a position behind the weapon 8. Here, too, the handling device 11 and, in particular, the ammunition body holding device 1 is arranged in the ammunition flow between the projectile magazine 9 and also in the ammunition flow between the propellant magazine 10 and the weapon 8, but also in the ammunition flow between the projectile magazine 12 and also in the ammunition flow between the propellant magazine 13 and the weapon 8. Ammunition bodies 6 could also be removed from one of the external ammunition body magazines 12, 13 by means of the ammunition body holding device 1, for example, and moved to one of the internal ammunition body magazines 9, 10, in order to fill and/or empty these with/of ammunition. Alternatively, or in addition, filling and/or emptying with/of ammunition between an external ammunition body store 15 and the weapon 8 and/or the magazines 9, 10 and/or the magazines 12, 13 can also take place in this exemplary embodiment. This is indicated by the dot-dash lines in FIG. 8 which depict the ammunition flows schematically.

Insofar as the ammunition body handling device 11 is also used for loading the weapon 8, it is also possible for the ammunition bodies 6 to be supplied directly to the weapon 8 from the external projectile magazine 13 and the external propellant magazine 14. Prior filling of the internal magazines 9, 10 with ammunition is not strictly necessary.

In FIGS. 4 to 8 it is also possible that instead of, or in addition to, the propellant magazine 10, at least one further projectile magazine 12 and/or at least one further propellant magazine 13 is/are arranged in the weapons system 14. Projectiles 6.2 and/or propellants 6.1 which are different from the projectiles 6.2 and/or propellants 6.1 in the magazines 9, 10 can be stored in these.

Figure 10:
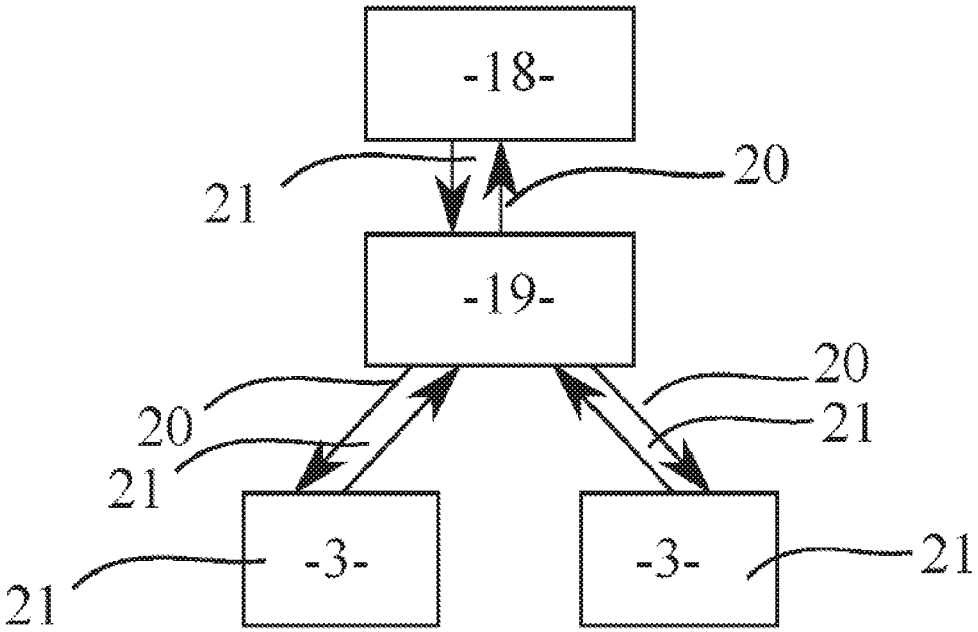
FIG. 10 shows a schematic representation of the pressure distribution.

FIG. 10 shows schematically the pressure distribution with a pressure generator 18, e.g. a controllable pump. The holding elements 3 are connected to the pressure generator 18 by means of a line and valve system. The holding elements 3 are connected to the pressure generator 18 via one or multiple lines 20 and one or multiple valves 19. The pressure generator 18 can introduce a fluid 21 into the inside of the holding elements 3 through the lines 20, as a result of which the holding element 3 expands. Similarly, the fluid 21 can also be drained from the holding element 3 again, as a result of which it contracts.

REFERENCE NUMBERS

1 Ammunition body holding device
2 Holder
2.1 Holder end
2.2 Center of the holder
3 Holding element
4 Connection
5 Ammunition body receiving means
6 Ammunition body
6.1 Projectile
6.2 Propellant
7 Holding face
8 Weapon
9 Projectile magazine
10 Propellant magazine
11 Handling device
12 External projectile magazine
13 External propellant magazine
14 Weapons system
15 Ammunition store
16 Guiding device
17 Hatch
18 Pressure generator
19 Valve

20 Line
21 Fluid
A Ammunition body axis/ammunition body holding device axis
R Radial direction

The invention claimed is:

1. An ammunition body holding device, comprising:

a holder for holding an ammunition body, wherein the holder has a plurality of expandable holding elements for holding the ammunition body, wherein at least a first and a second holding element are arranged along a circumference of the holder and at least the second and a third holding element are arranged in an axial direction, wherein the holding elements are configured to be individually controlled for expansion.

2. The ammunition body holding device as claimed in claim 1, wherein the holder can be adapted to different types of ammunition bodies, which are held by the expandable holding elements.

3. The ammunition body holding device as claimed in claim 1, wherein each expandable holding element is expandable through pressure of a fluid, wherein the fluid is introduced into an inside of the associated expandable holding element.

4. The ammunition body holding device as claimed in claim 1, further comprising a pressure generator for generating pressure in an inside of each expandable holding element.

5. The ammunition body holding device as claimed in claim 1, wherein a holding force can be set through an adjusted application of pressure in each expandable holding element.

6. The ammunition body holding device as claimed in claim 1, wherein each expandable holding element is expandable in a radial direction.

7. The ammunition body holding device as claimed in claim 1, wherein the ammunition body is clampable in the holder by the expandable holding elements.

8. The ammunition body holding device as claimed in claim 1, wherein the holder has at least two expandable holding elements extending in a radial direction and located along a circumference of the holder.

9. The ammunition body holding device as claimed in claim 8, wherein the expandable holding elements are arranged at ends of the holder and/or at a center of the holder.

10. The ammunition body holding device as claimed in claim 1, wherein each expandable holding element includes an expandable cushion.

11. A handling device for holding and/or moving an ammunition body, the handling device comprising:

an ammunition body holding device having a holder for holding an ammunition body, wherein the holder has a plurality of expandable holding element for holding the ammunition body, wherein at least a first and a second holding element are arranged along a circumference of the holder and at least the second and a third holding element are arranged in an axial direction, wherein the holding elements are configured to be individually controlled for expansion.

12. A weapons system having at least one ammunition body magazine, the weapons system comprising:

an ammunition body holding device having a holder for holding an ammunition body, wherein the holder has a plurality of expandable holding elements for holding the ammunition body, wherein at least a first and a second holding element are arranged along a circumference of the holder and at least the second and a third holding element are arranged in an axial direction, wherein the holding elements are configured to be individually controlled for expansion.

13. The weapons system as claimed in claim 12, wherein, in order to load the ammunition body magazine, the ammunition body holding device is arranged both in an ammunition flow between the ammunition body magazine and a weapon.

14. The weapons system as claimed in claim 12, wherein the ammunition body holding device can be used for filling and/or emptying of a propellant and/or a projectile.

15. A method for holding an ammunition body comprising:

providing an ammunition body holding device with a holder; and providing the holder with a plurality of expandable holding elements for holding the ammunition body, which the expandable holding elements are expanded for holding the ammunition body, wherein at least a first and a second holding element are arranged along a circumference of the holder and at least the second and a third holding element are arranged in an axial direction, wherein the holding elements are configured to be individually controlled for expansion.

16. The method as claimed in claim 15, further comprising contracting the expandable holding elements to release the ammunition body.

17. The method as claimed in claim 15, further comprising introducing a fluid into the expandable holding elements and adjusting a pressure in an inside of the expandable holding elements, as a result of which the expandable holding elements are expanded or contracted.

* * * * *